US006009602A

United States Patent [19]

Terada

[11] Patent Number: 6,009,602

[45] Date of Patent: Jan. 4, 2000

[54] SEPARABLE BOTTOM END STOP AND A SLIDER HAVING A LOCKING MECHANISM OF A SLIDE FASTENER

[75] Inventor: Yasuharu Terada, Toyama-ken, Japan

[73] Assignee: YKK Corporation, Tokyo, Japan

[21] Appl. No.: 09/212,382

[22] Filed: Dec. 16, 1998

[30] Foreign Application Priority Data

Dec. 18, 1997 [JP] Japan ..... 9-349729

[51] Int. Cl.[7] ..... A44B 19/00

[52] U.S. Cl. ..... 24/433; 24/421; 24/424; 24/429

[58] Field of Search ..... 24/433, 429, 424, 24/425, 426, 421, 419

[56] References Cited

U.S. PATENT DOCUMENTS

| | | | |
|---|---|---|---|
| 2,300,369 | 10/1942 | Kellum | 24/433 |
| 2,463,937 | 3/1949 | Austin | 24/433 |
| 2,892,231 | 6/1959 | Ulrich et al. | 24/433 |
| 3,320,645 | 5/1967 | Burbank | 24/421 |
| 4,422,220 | 12/1983 | Oda | 24/421 |
| 5,152,036 | 10/1992 | Oda et al. | 24/424 |

FOREIGN PATENT DOCUMENTS

| | | | |
|---|---|---|---|
| 0658650 | 10/1951 | United Kingdom | 24/433 |

*Primary Examiner*—Victor N. Sakran
*Attorney, Agent, or Firm*—Hill & Simpson

[57] ABSTRACT

A bottom end stop and a slider with a locking mechanism of a slide fastener chain which can be used for both the right side arrangement and the left side arrangement are provided. The slider includes a leaf spring showing a substantially U-shaped profile and having an end rigidly secured to a front part of the slider body, and the other end having a locking pawl arranged near the center thereof. The locking pawl resiliently projects into a guide groove for the engaging member located in the slider body. The bottom end stop includes an insert pin having a beveled escape area produced by cutting an edge of an upper outer surface of the insert pin facing the locking pawl, a groove formed on a surface facing a box pin of a box so as to engage with a ridge portion of the box pin when the insert pin is inserted into the box. The locking pawl is arranged between a top surface of the box pin and a bottom surface of the abutting portion provided at the top of the insert pin and the locking pawl is adapted to slide on the escape area when the insert pin is inserted into the box at the right side thereof. And when the insert pin is inserted into the box at the left side thereof, the locking pawl does not relate to the operation of the insert pin, thus the insert pin is inserted freely.

7 Claims, 5 Drawing Sheets

SEPARABLE BOTTOM END STOP AND A SLIDER HAVING A LOCKING MECHANISM OF A SLIDE FASTENER

BACKGROUND OF THE INVENTION

1. Field of the Invention

This invention relates to a bottom end stop and a slider having a locking mechanism of a slide fastener wherein the locking pawl of the slider is so improved that the locking pawl does not provide any obstacle when an insert pin is inserted into the box of the slide fastener.

2. Prior Art

In a conventional slide fastener chain having a bottom end stop adapted to separate its lower end into two portions, the bottom end stop and a slider having a locking mechanism is known, in which a locking pawl formed as part of a leaf spring of the slider having the locking mechanism and fitted to the fastener chain is located at a biased position where the locking pawl projects at some of the fastener elements, or engaging elements, that are not directly connected to a box pin and an insert pin of the bottom end stop, particularly on the engaging elements at the side of the fastener stringer where the box pin is fitted. With this arrangement, the locking pawl is not directly related to the fitting/removing operation of the insert pin into/out of the box so that the box pin and the insert pin do not require any specific machining process from the viewpoint of its relationship with the locking pawl.

In the conventional bottom end stop and the slider having the locking mechanism as described above, when the insert pin of the bottom end stop fitted to the fastener chain is inserted into the box, the insert pin is exclusively used on the right side if it is designed so, whereas it is exclusively used on the left side if it is designed as such. In other words, a same insert pin cannot be used on both the right side and the left side as viewed from the user. Thus, all slider components, assembling/machining apparatus for producing sliders and slide fasteners comprising such a slider have to be designed either for the right side arrangement or for the left side arrangement. This gives rise to cumbersome problems particularly in terms of production management and inventory control.

Particularly, in the case of a slider having a semi-automatic locking mechanism, the leaf spring of the slider having the locking pawl as part thereof that is produced by bending is thicker than the leaf spring of a slider having an automatic locking mechanism and the locking pawl is directed substantially perpendicularly toward a guide groove for guiding the engaging elements so that, if the locking pawl is located on the side where the insert pin is inserted, it is difficult for the insert pin to kick up the locking pawl and enter the box and hence the insert pin often cannot successfully be inserted into the box. This provides a problem that specifically hinders any attempt to use a same slider for both the right side arrangement and the left side arrangement.

In view of the above identified problems, it is therefore a principal object of the present invention to provide a bottom end stop of a slide fastener whose insert pin is designed to show a simple configuration adapted for escaping the locking pawl of the leaf spring of the slider having a locking mechanism and for being smoothly inserted into the slider and the box and to be usable for both the right side arrangement and the left side arrangement for the ease of production management and inventory control.

Another object of the invention is to provide a bottom end stop of a slide fastener with which the insert pin can be easily and accurately brought into releasable engagement with the box by specifying a manner in which the insert pin easily escape the locking pawl if the locking pawl of the leaf spring is arranged in a biased position.

Another object of the invention is to provide a bottom end stop of a slide fastener with which the insert pin can be brought into releasable engagement with the box in a specific manner so that it may be stably held in the box by so designing it as to make the insert pin appropriately escape the locking pawl.

Still another object of the invention is to provide an bottom end stop of a slide fastener with which the insert pin can be accurately and quickly inserted into the box at the left side or the right side, whichever appropriate, by specifying the location where the locking pawl of the leaf spring of the slider having a locking mechanism projects.

A further object of the invention is to provide a bottom end stop of a slide fastener with which the insert pin can be inserted into the box easily and accurately and avoid any unintended engagement with the locking pawl during the inserting operation.

A still further object of the invention is to provide a slider having a locking mechanism suited for the bottom end stop of a slide fastener and having a mechanism for the insert pin of the bottom end stop to easily escape the locking pawl of the leaf spring of the slider having the locking mechanism.

A still further object of the invention is to provide a slider having a semi-automatic type locking mechanism that uses a thick leaf spring and most suited for the bottom end stop and having a mechanism for the insert pin of the bottom end stop to easily escape the locking pawl of the leaf spring of the slider having the locking mechanism.

SUMMARY OF THE INVENTION

According to the invention, the principal object of the invention is achieved by providing a separable bottom end stop and a slider having a locking mechanism of a slide fastener in which the slider includes a leaf spring showing a substantially U-shaped profile and having an end rigidly secured to a front part, i.e. a guide post, of a slider body, and the other end of the leaf spring having a locking pawl arranged near the center thereof, the locking pawl being resiliently projecting into a guide groove for engaging elements located in the slider body, The bottom end stop includes a box, a box pin fitted in the box and an insert pin, to be inserted into the box, having a beveled escape area produced by cutting an edge of an upper outer surface of the insert pin facing the locking pawl so as to allow the locking pawl to be retractably moved onto the insert pin.

Preferably, the beveled escape area of the insert pin for escaping the locking pawl is formed by cutting an edge of the insert pin from the distal end thereof to a base of an abutting portion disposed at the top of the insert pin and having a profile same as that of the engaging element projecting outwardly.

And preferably, the box pin provided on the box has a ridge portion projecting outwardly from a top portion, namely from an outer surface of the top thereof and the abutting portion of the insert pin has a groove on an outer lower surface thereof, the ridge portion and the groove being adapted to abut and come into engagement with each other.

Preferably, the locking pawl of the locking mechanism is adapted to resiliently and retractably project into a space between a top surface, i.e. a top portion of the box pin and a bottom surface of the abutting portion of the insert pin and to realize insertion operation for both the right side arrangement and the left side arrangement.

Further preferably, the outer surface of the insert pin or the surface facing the box pin is slightly bent and the escape area for the locking pawl is formed by cutting an edge in the distal half thereof to produce a first beveled surface area and cutting it in the other half thereof to produce a second beveled surface area and a horizontal surface area.

Still preferably, the leaf spring of the locking mechanism has a recessed portion arranged at an upper end of the locking pawl projecting near the center of an extremity thereof and adapted to accommodate the axis of the pull tab, and the base portion of the other extremity of the leaf spring is secured to a guide post of the slider body so as to make the leaf spring swingable by the motion of the axis of the pull tab accommodated in the recessed portion of the leaf spring.

And still preferably, a U-shaped wall is arranged in front of the guide post of the slider body to surround the front side of the guide post, the upper end of the wall is projecting above the slider body to protect the leaf spring, the base portion of the leaf spring is provided with lateral notches to be inserted into and securely held in engagement with a projecting portion arranged on the front surface of the guide post, the locking pawl at the front end of the leaf spring is inserted into and engaged with a pawl hole cut through the slider body, the axis of the pull tab is put through the recessed portion of the leaf spring and provided with a cam portion for actuating the leaf spring, and the opposite ends of the axis are rotatably held by the bearing portions of the slider body projecting upward from the slider body so as to rotate the cam portion of the axis to make the locking pawl of the leaf spring project and retreat by the swinging motion of the pull tab.

DESCRIPTION OF THE PREFERRED EMBODIMENT OF THE INVENTION

Now, a bottom end stop and a slider having a locking mechanism of a slide fastener according to the invention will be described in greater detail by referring to the accompanying drawings that illustrate a preferred embodiment of the invention.

Figure 1:
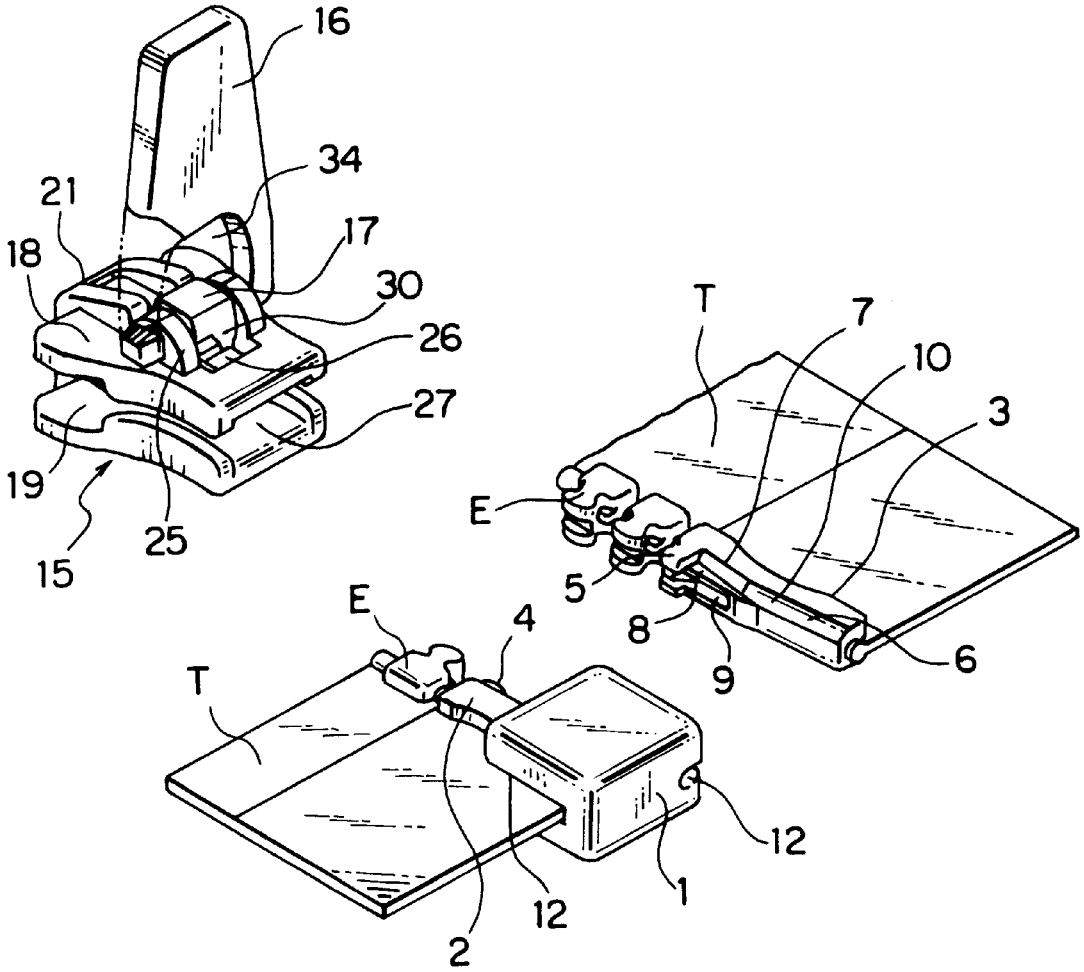
FIG. 1 is a schematic perspective view of a bottom end stop and a slider having a locking mechanism according to the invention.

Referring to FIG. 1, the bottom end stop of a slide fastener according to the invention comprises a box 1, a box pin 2 and an insert pin 3 that are made of materials selected from polyamide, polyacetal, polypropylene, polybutyleneterephthalate and other thermoplastic resin and integrally formed by injection molding or extrusion molding.

Figure 4:
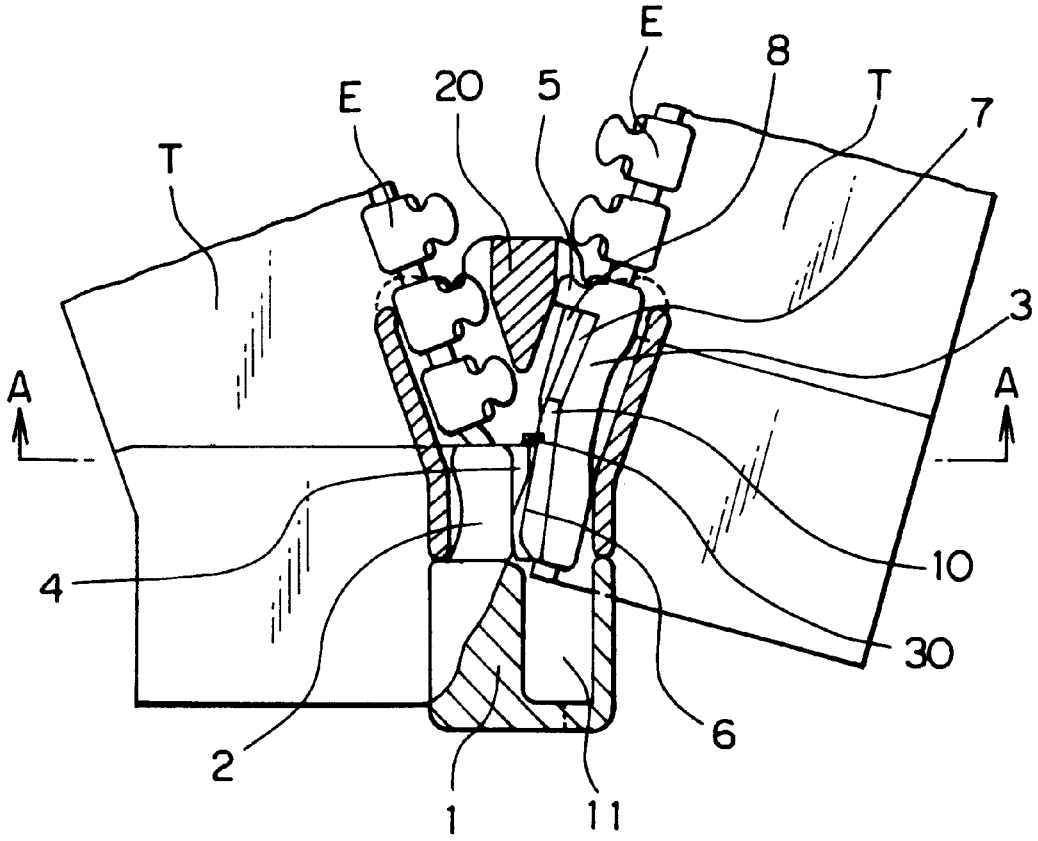
FIG. 4 is a schematic transversal cross sectional view of an insert pin of the slider according to the invention as being inserted into a corresponding box of left side arrangement, showing a principal portion thereof.

The box pin 2 has a substantially prism-shaped profile and is molded integrally to be fitted to an edge of a fastener stringer tape and arranged adjacent to engaging elements E, or fastener. Additionally, the box pin 2 has a ridge portion 4 having a triangular plan view and a protruding cross sectional view as shown in FIG. 4 and located at the top i.e. next to the engaging element E and along the outer edge of the box pin 2, the top of the ridge portion 4 being flush with that of the box pin 2.

While the illustrated engaging elements E are integrally molded of thermoplastic resin and arranged along the longitudinal edge of a fastener stringer tape T, they may be replaced by metal engaging elements E formed by die casting or thin plate working. If metal engaging elements are used, the bottom end stop consisted of the box, the box pin and the insert pin is preferably made of zinc alloy or aluminum alloy and formed by die casting.

On the other hand, the insert pin 3 is longer than the box pin 2 and has a substantially prism-like profile. It is slightly bent so that it may be operated with ease for insertion. It is molded integrally to be fitted to an edge of another fastener stringer tape T and arranged adjacent to the engaging elements E. An abutting portion 5 is integrally formed at the top of the insert pin 3 and adjacent to the neighboring engaging element E to show a profile similar to that of the engaging element E but having a lower half thereof cut off, the engaging/abutting portion 5 facing outwardly like the engaging element E.

The insert pin 3 is cut along an edge of the distal half thereof to produce a first beveled surface area 6 and cut along the edge of the other half thereof to a base of the abutting portion 5 to produce a second beveled surface area 7 at an inner portion thereof and a horizontal surface area 8 at an outer portion thereof. The first and second beveled surface areas 6, 7 and the horizontal surface area 8 form an escape area 10 for escaping any possible engagement with the locking pawl 30 of the slider. Additionally, the insert pin 3 has a groove 9 on the outer surface near the top thereof, the groove 9 having a cross sectional view adapted to abut and become engaged with the ridge portion 4 of the box pin 2.

The box 1 shows a substantially prism-like profile having a length equal to about a half of that of the box pin 2 and has an accommodation hole for receiving the box pin 2 on one side and an insertion hole 11 for receiving the insert pin 3 on the other side. Additionally, the box 1 has along the opposite lateral sides thereof slots 12 for respectively receiving fastener stringer tapes T, the slots 12 being in communication with the accommodation hole and the insertion hole 11 respectively. The box pin 2 is inserted into the accommodation hole and immovably secured there by an appropriate means. Note that the box 1 and the box pin 2 may be formed integrally with each other at the time of molding.

Figure 2:
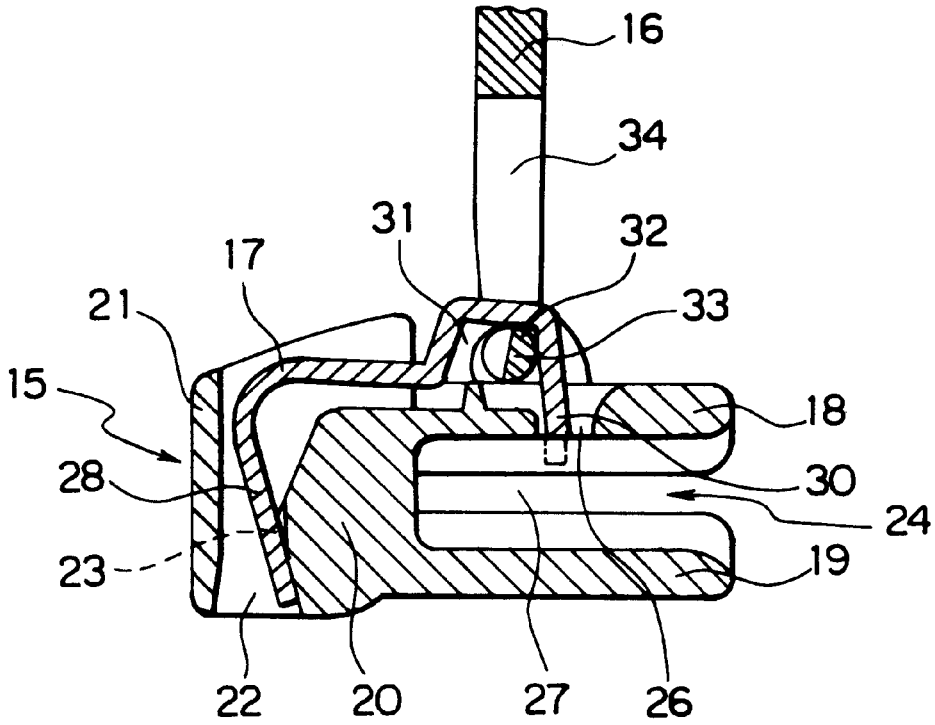
FIG. 2 is a schematic longitudinal cross sectional view of the slider having the locking mechanism according to the invention.
Figure 3:
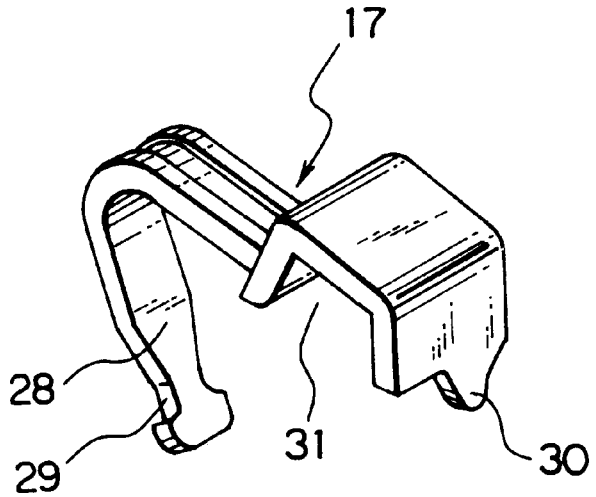
FIG. 3 is a schematic perspective view of a leaf spring of the slider according to the invention.

Referring now to FIGS. 2 and 3, the slider having the locking mechanism comprises a slider body 15, a pull tab 16 and a leaf spring 17, of which the body 15 is typically made of aluminum alloy, zinc alloy or some other metal and formed by die casting. The body 15 has an upper wing 18, a lower wing 19 connected by a guide post 20, the front of the guide post 20 being surrounded by a wall 21 projecting above the surface of the upper wing 18 to protect the leaf spring 17 to be arranged there. A gap 22 is formed between the wall 21 and the guide post 20 to accommodate a base portion 28 of the leaf spring 17. In other words, the guide post 20 has at a front lower portion thereof two projections 23 projecting into the gap 22 to hold the base portion 28 of the leaf spring 17 therebetween.

The slider body 15 additionally has a pair of bearing portions 25 for supporting an axis 32 of the pull tab 16, the bearing portions 25 extending between the rear end of the wall 21 and a rear opening 24 of the slider body 15, and a pawl hole 26 for receiving the locking pawl 30 perpendicularly toward the guide groove 27 so as to operate is cut through the slider body 15 between the bearing portions 25 and extends to the guide groove 27 for guiding the engaging elements E.

Referring to FIG. 3, the leaf spring 17 generally shows a substantially U-shaped profile and has lateral notches 29 arranged at the base portion 28 of an end thereof and a locking pawl 30 located near the center of the other end and projecting substantially perpendicularly toward the guide groove 27, a recessed portion 31 being arranged at the upper end of the locking pawl 30 and adapted to accommodate the axis 32 of the pull tab 16 of the slider.

The pull tab 16 is made of an oblong plate and has at an end thereof an opening 34 that allows the leaf spring 17 to pass therethrough and forms the axis 32 for the pull tab 16. The axis 32 has a semi-cylindrical cam portion 33 that shows its flat surface upward when the pull tab 16 is turned toward the rear opening 24 of the slider body 15. However, the cam portion 33 does not necessary have to show a semi-cylindrical profile and may alternatively have a flat oval in cross section profile if it actuates the leaf spring 17 when the pull tab is pulled to operate the slider.

The slider having the locking mechanism is assembled in a manner as described below. Firstly, the axis 32 of the pull tab 16 is put on to be supported by the bearing portions 25 projecting from the slider body 15. Then the leaf spring 17 is made to abut the axis 32 from above and the lateral notches 29 of the base portion 28 of the leaf spring 17 is brought into engagement with and securely held by the respective projections 23 arranged at the front side of the guide post 20 so that the locking pawl 30 at the front end of the leaf spring 17 may always be resiliently projecting into the guide groove 27. Thus, as the pull tab 16 is turned to its standing position, the leaf spring 17 is lifted by the cam portion 33 of the axis 32 to move the locking pawl 30 out of the guide groove 27 so that the slider maybe freely moved along the side fastener. When the pull tab 16 is turned flat toward the rear opening 24, the locking pawl 30 projects into the guide groove 27 and becomes inserted between a pair of engaging members E to semi-automatically stop the slider.

The lateral notches 29 provided in the base portion 28 of the leaf spring 17 may be replaced by a through hole in the base portion 28 and a single projection may be provided at the front side of the guide post 20 that comes into engagement with the through hole to securely hold the leaf spring 17.

Figure 5:
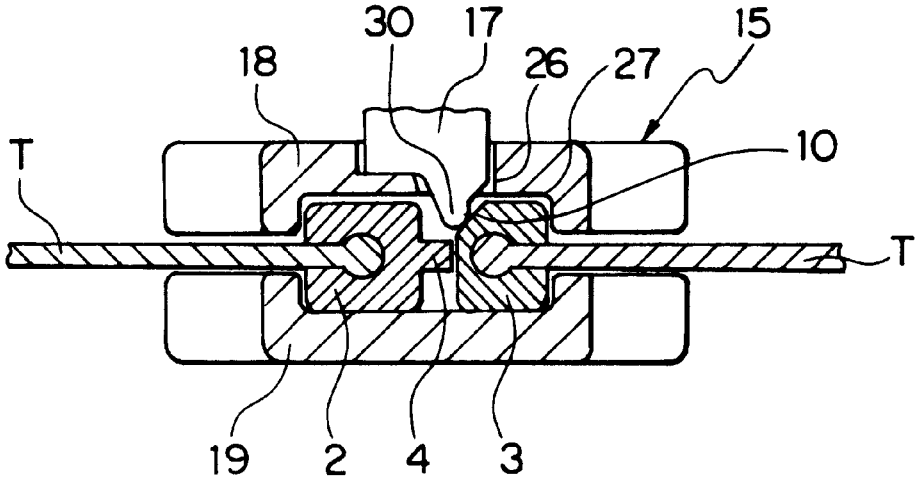
FIG. 5 is a schematic cross sectional view of the insert pin of FIG. 4 taken along line A—A in FIG. 4.
Figure 6:
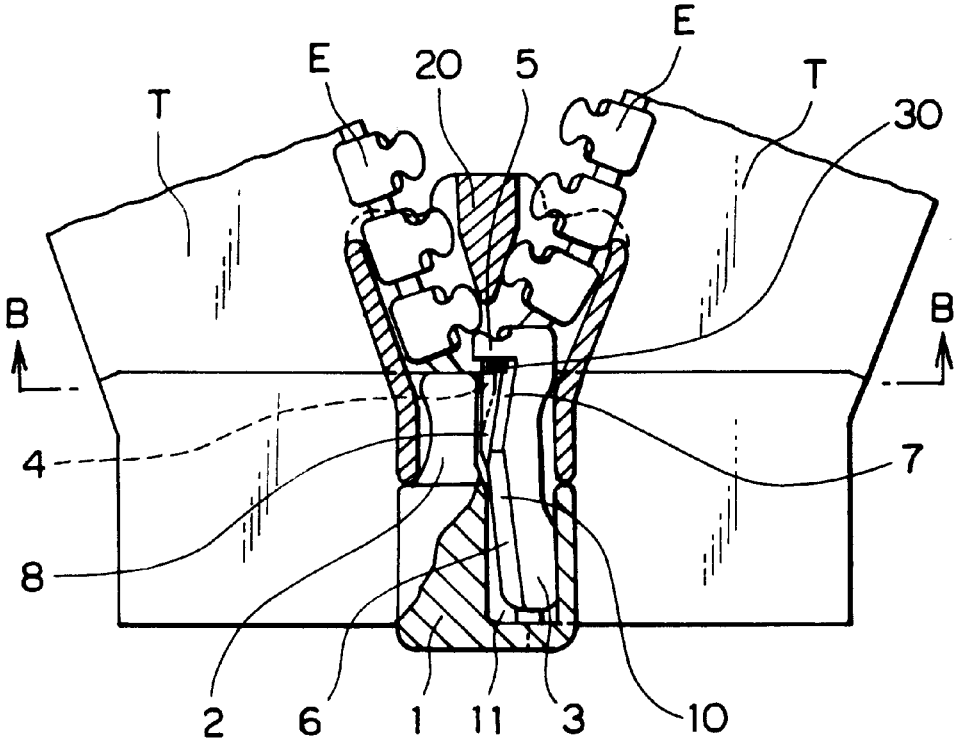
FIG. 6 is a schematic transversal cross sectional view of the insert pin of the slider according to the invention when completely inserted into the box of left side arrangement, showing a principal portion of thereof.
Figure 7:
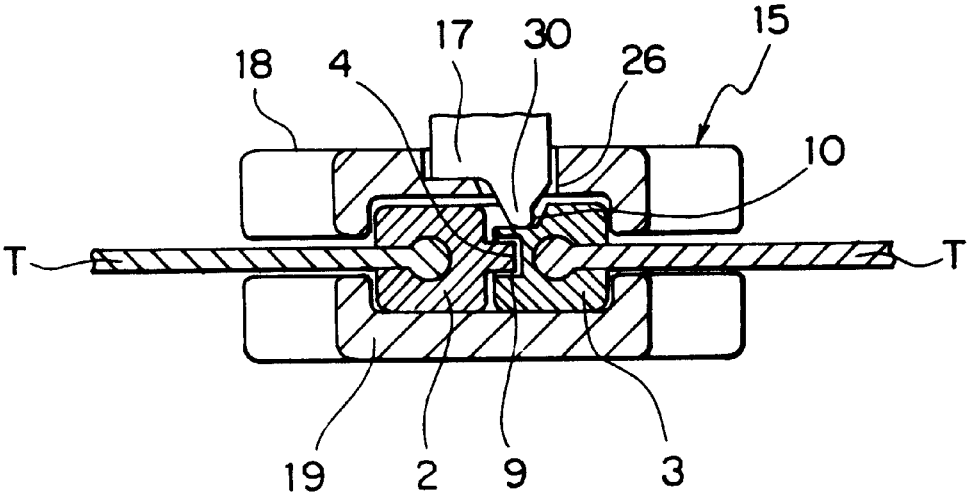
FIG. 7 is a schematic cross sectional view of the insert pin of FIG. 6 taken along line B—B in FIG. 6.

Now, a manner of operation of the bottom end stop and the slider having the locking mechanism according to the invention will be described by referring to FIGS. 4 and 5. As illustrated, the slider held in slidable engagement with a pair of fastener stringers is made to slide along the fastener stringer until it abuts the box 1 rigidly secured to the fastener stringer tapes T and the insert pin 3 fitted to one of the fastener stringer tapes T is inserted into the guide groove 27 of the slider and, thereafter, into the insertion hole 11 of the box 1 as shown in FIGS. 6 and 7. During this operation, the locking pawl 30 is constantly projecting into the guide groove 27 at the side of the insert pin 3 of the slider. However, the locking pawl 30 is prevented from unintendedly locking because of the provision of the first and second beveled surface areas 6, 7 and the horizontal surface area 8 of the escape area 10 so that the insert pin 3 can smoothly move into the box 1. Additionally, the locking pawl 30 is so arranged as to be located between the top surface of the box pin 2 and the bottom surface of the abutting portion 5 of the insert pin 3 and the escape area 10 arranged at an edge of the insert pin 3 is made longer than the box pin 2. Thus, once the insert pin 3 is inserted, the fastener chain is closed by moving the pull tab 16 to a standing position and pulling it upward.

Figure 8:
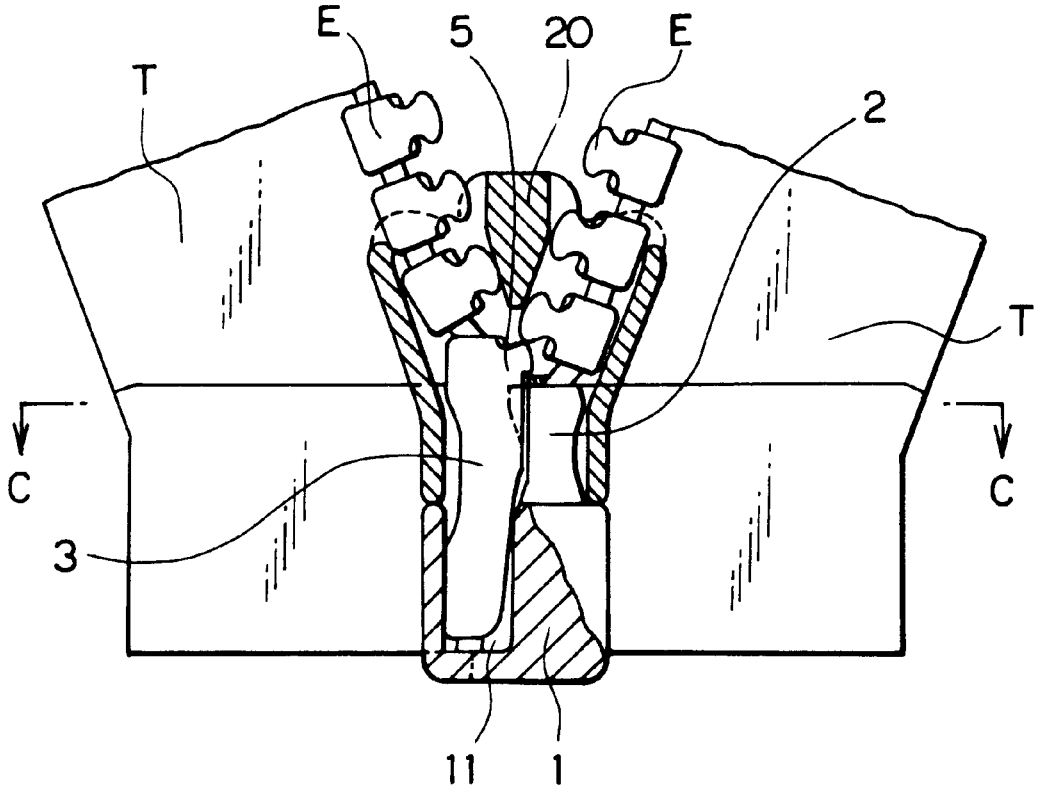
FIG. 8 is a schematic transversal cross sectional view of the insert pin of the slider according to the invention when completely inserted into the box of right side arrangement, showing a principal portion thereof.
Figure 9:
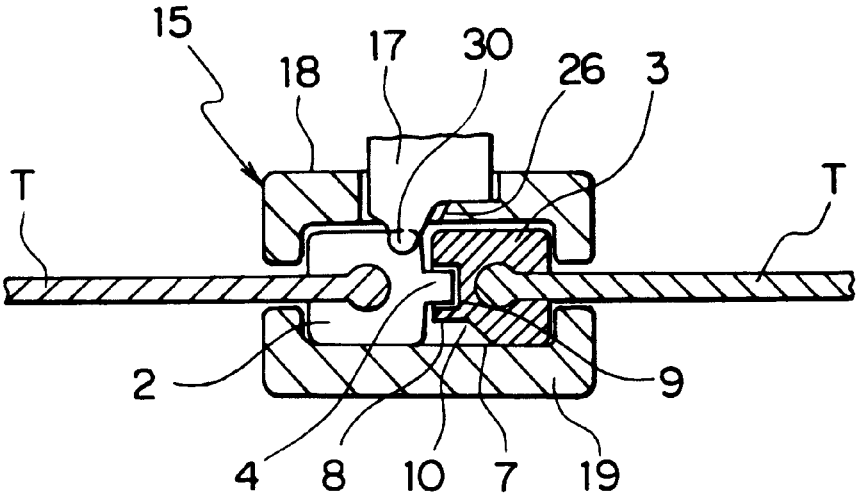
FIG. 9 is a schematic cross sectional view of the insert pin of FIG. 8, taking along line C—C in FIG. 8.

The manner of operation as described above by referring to FIGS. 4 through 7 refers to a slide fastener typically fitted to the front edges of a jacket, wherein the fastener stringer having the insert pin 3 is arranged at the left side and the fastener stringer having the box pin 2 and the box 1 is arranged at the right side of the user to show a so-called left side arrangement or an arrangement where the insert pin 3 is inserted to a left half portion of the box 1. To the contrary, in the case of a right side arrangement of insert pin 3 as shown in FIGS. 8 and 9, where the slider having the locking mechanism having the box 1, box pin 2 and the insert pin 3 of the above-described profile and to be inserted through the fastener chain is arranged at the opposite side, i.e. inside out, the locking pawl 30 of the leaf spring 17 project onto the engaging element E on the side of the box pin 2. Then, as the slider is made to abut the box 1 and halt, the locking pawl 30 is located outside the top of the box pin 2 as shown in FIG. 8, so that the insert pin 3 can easily be inserted into the insertion hole 11 of the box 1 without touching the locking pawl 3 as shown in FIG. 9. Thus, it will be appreciated that the insert pin 3 of this embodiment can be used with the box 1 for both the right side arrangement and the left side arrangement.

Advantages of the Invention

The bottom end stop and the slider with the locking mechanism according to the invention and having a on figuration as described above provides the following advantages.

According to the invention, as the leaf spring 17 showing a substantially U-shaped profile has an end rigidly secured to a front part, or guide post 20, of the slider body 15, and the other end having the locking pawl 30 arranged near the center thereof, the locking pawl 30 being resiliently projecting into the guide groove 27. The bottom end stop has the insert pin 3 showing the beveled escape area 10 produced by cutting an edge of the upper surface of the insert pin 3 facing the locking pawl 30 so as to allow the locking pawl 30 to be retractably moved onto the insert pin 3. Thus, the powerful leaf spring 17 can be arranged for the slider body 15 and, since the insert pin 3 is provided with the escape area 10 for escaping the locking pawl 30 even when the locking pawl 30 is moved toward and away from the insert pin 3, the insert pin 3 can be inserted into the slider according to the invention with ease unlike any comparable conventional sliders and hence can be used for both the right side arrangement and the left side arrangement without changing its profile, for the ease of production management and inventory control.

As the beveled escape area 10 of the insert pin 3 for escaping the locking pawl 30 is formed by cutting an edge of the insert pin 3 from the distal end thereof to the base of the abutting portion 5 of the insert pin 3 having a profile similar to half of that of the fastener element E and projecting outwardly, the insert pin 3 can have a long escape area for escaping the locking pawl 30 so that it can be easily and accurately brought into releasable engagement with the box 1.

As the box 1 of the slide fastener includes the box pin 2 having the ridge portion 4 projecting outwardly from the top portion thereof and the abutting portion 5 of the insert pin 3 having the profile similar to that of the fastener elements E has the groove 9 on the outer surface of the top thereof, the ridge portion 4 and the groove 9 being adapted to abut and come into engagement with each other, the insert pin 3 can be brought into releasable engagement with the box pin 2 so that it may be easily inserted into and held in position in the box 1 and appropriately escapes the locking pawl 30.

As the locking pawl 30 of the locking mechanism is adapted to resiliently and retractably project into the space between the top surface of the box pin 2 and the bottom surface of the abutting portion 5 of the insert pin 3 and operate for both the right side arrangement and the left side arrangement, then the insert pin 3 can be accurately and quickly inserted into the box 1 at the left side or the right side, whichever appropriate, with a simple switching operation.

As the outer surface of the insert pin 3 or the surface facing the box pin 2 is slightly bent and the escape area 10 of the locking pawl 30 is formed by cutting the edge in the distal half thereof to produce the first beveled surface area 6 and cutting it in the other half thereof to produce the second beveled surface area 7 and the horizontal surface area 8, the insert pin 3 can be inserted into the box 1 easily and accurately and avoid any unintended engagement with the locking pawl 30 during the inserting operation.

As the leaf spring 17 has the recessed portion 31 arranged at the upper end of the locking pawl 30 projecting near the center of an extremity thereof and adapted to accommodate the axis 32 of the pull tab 16 of the slider, with the base portion 28 in the other extremity of the leaf spring 17 being secured to the guide post 20 of the slider body 15 so as to make the leaf spring 17 swingable by the motion of the axis 32 of the pull tab 16 accommodated in the recessed portion 31 of the leaf spring 17, the insert pin 3 can be inserted with ease into the box 1 and such a slider with the locking mechanism is particularly suited for use with the bottom end stop adapted to both the left side arrangement and the right side arrangement.

Finally, as the U-shaped wall 21 is arranged in front of the guide post 20 of the slider body 15 to surround the front side of the guide post 20 and the upper end of the wall 21 is projecting above the slider body 15, the base portion 28 of the leaf spring 17 being provided with lateral notches 29 to be inserted into and securely held in engagement with the projecting portions 23 arranged on the front surface of the guide post 20, the locking pawl 30 at the front end of the leaf spring 17 being inserted into and engaged with the pawl hole 26 cut through the slider body 15, the axis 32 of the pull tab 16 being put through the recessed portion 31 of the leaf spring 17 and provided with the cam portion 33 for actuating the leaf spring 17, the opposite ends of the axis 32 being rotatably held by the bearing portions 25 of the slider body 15 projecting upward from the slider body 15 so as to make the locking pawl 30 of the leaf spring 17 project and retreat by the swinging motion of the pull tab 16, the leaf spring can be protected and avoided from any unintended disengagement. And the leaf spring 17 can be easily secured even if it has a great thickness. Additionally, the slider can be moved with ease by pulling the pull tab to a standing position so that the above arrangement is particularly suited for a slider having a semi-automatic type locking mechanism to be used with the bottom end stop adapted to both the left side arrangement and the right side arrangement for the insert pin 3.

What is claimed is:

1. A separable bottom end stop and a slider having a locking mechanism of a slide fastener, said slider comprising a slider body, a pull tab, and a leaf spring wherein said leaf spring shows a substantially U-shaped profile and has an end rigidly secured to a front part of the slider body and the other end having a locking pawl arranged near the center thereof, the locking pawl being resiliently projecting into a guide groove and engageable with engaging elements located in the slider body, said bottom end stop comprising a box, a box pin fitted in said box and an insert pin, wherein said insert pin to be inserted into said box has an upper outer surface facing the locking pawl, a side facing the box pin, and a beveled escape area having a beveled edge between the upper outer surface and the side of the insert pin facing the box pin so as to allow the locking pawl to be retractably moved onto the insert pin.

2. A bottom end stop of a slide fastener according to claim 1, wherein the beveled escape area of the insert pin for escaping the locking pawl is formed by cutting an edge of the insert pin from the distal end thereof to a base of an abutting portion disposed at the top of the insert pin and projecting outwardly.

3. A bottom end stop of a slide fastener according to claim 2, wherein said box pin has a ridge portion projecting outwardly from a top portion thereof and the abutting portion of the insert pin has a groove on an outer lower surface thereof, said ridge portion and said groove being adapted to abut and come into engagement with each other.

4. A bottom end stop of a slide fastener according to claim 2, wherein said locking pawl is adapted to resiliently and retractably project into a space between a top surface of the box pin and a bottom surface of the abutting portion of the insert pin and operate for both the right side arrangement and the left side arrangement.

5. A bottom end stop of a slide fastener according to claim 1, wherein the outer surface of the insert pin or the surface facing the box pin is slightly bent and the escape area for the locking pawl is formed by cutting an edge in the distal half thereof to produce a first beveled surface area and cutting it in the other half thereof to produce a second beveled surface area and a horizontal surface area.

6. A slider having a locking mechanism of a slide fastener according to claim 1, wherein said leaf spring has a recessed portion arranged at an upper end of the locking pawl projecting near the center of an extremity thereof and adapted to accommodate the axis of the pull tab of the slider, and the base portion of the other extremity of the leaf spring is secured to a guide post of the slider body so as to make the leaf spring swingable by the motion of the axis of the pull tab accommodated in the recessed portion of the leaf spring.

7. A slider having a semi-automatic locking mechanism of a slide fastener according to claim 6, wherein a U-shaped wall is arranged in front of the guide post of the slider body to surround the front side of the guide post, the upper end of the wall is projecting above the slider body, the base portion of the leaf spring is provided with lateral notches to be inserted into and securely held in engagement with a projecting portion arranged on the front surface of the guide post, the locking pawl at the front end of the leaf spring is inserted into and engaged with a pawl hole cut through the slider body, the axis of the pull tab is put through the recessed portion of the leaf spring and provided with a cam portion for actuating the leaf spring, and the opposite ends of the axis are rotatably held by the bearing portions of the slider body projecting upward from the slider body so as to make the locking pawl of the leaf spring project and retreat by the swinging motion of the pull tab.

* * * * *